US008689537B1

(12) United States Patent
Burton et al.

(10) Patent No.: US 8,689,537 B1
(45) Date of Patent: Apr. 8, 2014

(54) MICRO-CAVITY DISCHARGE THRUSTER (MCDT)

(75) Inventors: Rodney L. Burton, Champaign, IL (US); James Gary Eden, Champaign, IL (US); Sung-Jin Park, Savoy, IL (US); David L. Carroll, Urbana, IL (US)

(73) Assignee: CU Aerospace, LLC, Champaign, IL (US)

( * ) Notice: Subject to any disclaimer, the term of this patent is extended or adjusted under 35 U.S.C. 154(b) by 1206 days.

(21) Appl. No.: 12/589,182

(22) Filed: Oct. 19, 2009

Related U.S. Application Data

(60) Provisional application No. 61/106,752, filed on Oct. 20, 2008.

(51) Int. Cl.
*F03H 1/00* (2006.01)
*H05H 1/02* (2006.01)

(52) U.S. Cl.
USPC ..... 60/202; 60/203.1

(58) Field of Classification Search
USPC ..... 60/203.1, 202, 204; 313/582
See application file for complete search history.

(56) References Cited

U.S. PATENT DOCUMENTS

| | | | | |
|---|---|---|---|---|
| 4,918,468 | A * | 4/1990 | Miekka et al. | 347/126 |
| 6,286,304 | B1 * | 9/2001 | Back et al. | 60/202 |
| 6,295,804 | B1 | 10/2001 | Burton et al. | |
| 6,465,964 | B1 * | 10/2002 | Taguchi et al. | 315/111.21 |
| 2005/0257515 | A1 * | 11/2005 | Song | 60/202 |
| 2006/0071598 | A1 * | 4/2006 | Eden et al. | 313/631 |

FOREIGN PATENT DOCUMENTS

WO WO 2007011388 A2 * 1/2007

OTHER PUBLICATIONS

Becker et al. (Microplasmas and applications, 2006).*
Seo et al. (Two-dimensional simulation of ac-driven microplasmas confined to 100-300um diameter cylindrical microcavities in dielectric barrier devices).*
Park, Kim & Eden (Ultraviolet emission intensity, visible luminance, and electrical characteristics of small arrays of Al/Al2O3 microcavity plasma devices operating in Ar/N2 or Ne at high-power loadings, 2006).*
Carazo (Piezoelectric Transformers for Space Applications).*
WiseGeek (http://www.wisegeek.com/what-is-apower- inverter. htm.).*
Bayt et al. ( Viscous effects in supersonic MEMS-fabricated micronozzles, Nov. 1998).*
Sawanda et al. (Micro-Plasmajet Array: Numerical Simulation on Thrust Improvement of Multi-Jet Effect, Sep. 17, 2007).*
K H Becker, K H Schoenbach and J G Eden, Microplasmas and applications, Journal of Physics D: Applied Physics, Jan. 20, 2006, pp. R55-R70, IOP Publishing Ltd.

(Continued)

*Primary Examiner* — Andrew Nguyen
(74) *Attorney, Agent, or Firm* — Adam K. Sacharoff

(57) ABSTRACT

It is disclosed herein a breakthrough concept for in-space propulsion for future Air Force, NASA and commercial systems. The invention combines the fields of micro-electrical-mechanical (MEMs) devices, optical physics, and nonequilibrium plasmadynamics to reduce dramatically the size of electric thrusters by 1-2 orders of magnitude, which when coupled with electrodeless operation and high thruster efficiency, will enable scalable, low-cost, long-life distributable propulsion for control of microsats, nanosats, and space structures. The concept is scalable from power levels of 1 W to tens of kilowatts with thrust efficiency exceeding 60%. Ultimate specific impulse would be 500 seconds with helium, with lower values for heavier gases.

17 Claims, 7 Drawing Sheets
(2 of 7 Drawing Sheet(s) Filed in Color)

(56) References Cited

OTHER PUBLICATIONS

Rodney L. Burton, Filip Rysanek, Erik A. Antonsen, Michael J. Wilson and Stewart S. Bushman, Pulsed Plama Thruster Performance for Microspacecraft Propulsion, JPP/Special Issue on Microspacecraft Propulsion.

R. L. Burton and P.J. Turchi, Pulsed Plasma Thruster, Journal of Propulsion and Power, Sep.-Oct. 1998, pp. 716-735, vol. 14, No. 5.

Rodney L. Burton, J. Gary Eden, Sung-Jin Park, Je Kwon Yoon, Mark De Chadenedes, Steven Garrett, Laxminarayan L. Raja, Hariswaran Sitaraman, Julia Laystrom-Woodard, Gabriel Benavides and David Carroll, Initial Development of the Microcavity Discharge Thruster, The 31st International Electric Propulsion Conference, Sep. 20-24, 2009, University of Michigan, USA.

Stewart S. Bushman and Rodney L. Burton, Heating and Plasma Properties in a Coaxial Gasdynamic Pulsed Plasma Thruster, Journal of Propulsion and Power, Sep.-Oct. 2001, pp. 959-966, vol. 17, No. 5.

K. S. Kim, T. L. Kim, J. K. Yoon, S. J. Park and J. G. Eden, Control of Cavity Cross Section in Microplasma Devices: Luminance and Temporal Response of 200×100 and 320×160 arrays and parabolic Al2O3 Microcavities, Applied Physics Letters, Jan. 9, 2009, 94, 011503-1, American Institute of Physics.

S. J. Park, K. S. Kim and J. G. Eden, Ultraviolet Emission Intensity, Visible Luminance, and Electrical Characteristics of Small Arrays of Al/Al2O3 Microcavity Plasma Devices Operating in Ar/N2 or Ne a High-Power Loadings, Journal of Applied Physics, Jan. 26, 2006, 99, 026107-1, American Institute of Physics.

S. J. Park, K. S. Kim and J. G. Eden, Nonporous Alumina as a Dielectric for Microcavity Plasma Device: Multiplayer Al/A1203 Structures, Applied Physics Letters, May 24, 2005, 86, 221501-1, American Institute of Physics.

S. J. Park, K. S. Kim and J. G. Eden, Self-patterned Aluminum Interconnects and Ring Electrodes for Arrays of Microcavity Plasma Devices Encapsulated in Al2O3, Journal of Physics D: Applied Physics, Dec. 12, 2007, pp. 1-4, IOP Publishing Ltd.

Nicholas T. Tiliakos, Rodney L. Burton and Herman Krier, Arcjet Anode Plasma Measurements Using Electrostatic Probes, Journal of Propulsion and Power, Jul.-Aug. 1998, pp. 560-567, vol. 14, No. 4.

Gary F. Willmes and Rodney L. Burton, Low-Power Helium Pulsed Arcjet, Journal of Propulsion and Power, May-Jun. 1999, pp. 440-446, vol. 15 No. 3.

M. J. Wilson, S. S. Bushman and R. L. Burton, A Compact Thrust Stand for Pulsed Plasma Thrusters, IEPC 1997 25th, Aug. 24-28, 1997, Electric Rocket Propulsion Society, Cleveland, Ohio.

* cited by examiner

MICRO-CAVITY DISCHARGE THRUSTER (MCDT)

RELATED APPLICATIONS

The present invention claims priority to U.S. Provisional Application 61/106,752 filed Oct. 20, 2008.

BACKGROUND OF THE INVENTION

The Air Force, DoD, NASA, and commercial spacecraft manufacturers all have a growing interest in replacing small chemical thrusters, reaction wheels, and magnetic torque rods with more advanced, lighter weight, lower power, more controllable micro-propulsion alternatives. In addition to this need, propellant mass and power scalability is highly desirable, thus opening up a wide range of applications for micro-, nano-, and pico-satellites, and the control of flexible structures. Furthermore, ultra-compact packaging and extremely low mass of the propulsion system is highly desirable to achieve optimal thruster placement on the spacecraft, to maximize control without adversely impacting fields-of-view, and to minimize the exposure of sensors to exhaust plume impingement.

SUMMARY OF THE INVENTION

It is disclosed herein a breakthrough concept for in-space propulsion for these future Air Force systems. The invention combines the fields of micro-electrical-mechanical (hereinafter, MEMs) devices, optical physics, and non-equilibrium plasma-dynamics to reduce dramatically the size of electric thrusters by 1-2 orders of magnitude, which when coupled with electrodeless operation and high thruster efficiency, will enable scalable, low-cost, long-life distributable propulsion for control of micro-satellites, nano-satellites, and space structures. The concept is scalable from power levels of about 1 W to tens of kilowatts with thrust efficiency exceeding 60%. Ultimate specific impulse would be about 560 seconds with helium, with lower values for higher molecular weight propellants.

Numerous advantages and features of the invention will become readily apparent from the following detailed description of the invention and the embodiments thereof, and from the accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee. Better understanding of the aforementioned invention may be had by referencing the accompanying drawings, wherein.

DESCRIPTION OF THE INVENTION

Figure 1:
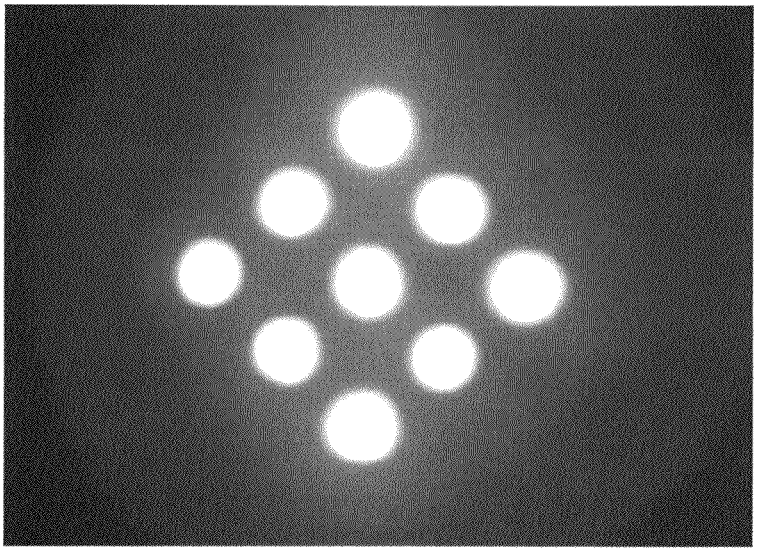
FIG. 1 Prior Art
FIG. 1. is a prior art photograph of a MEMS Micro-Cavity Discharge (MCD) array, producing a blue plasma light.

While the invention is susceptible to embodiments in many different forms, the preferred embodiments of the present invention are shown in the drawings (FIGS. 2 and 5) and will be described in detail herein. It should be understood, however, that the present disclosure is to be considered an exemplification of the principles of the invention and is not intended to limit the spirit or scope of the invention and/or the embodiments illustrated. It is to be understood that no limitation with respect to the specific methods and apparatus illustrated herein is intended or should be inferred.

The heart of the invention is a technology breakthrough MEMs-scale plasma discharge (FIG. 1), developed in Prof. Gary Eden's laboratory at the University of Illinois, called the microcavity discharge (MCD), the properties of which are highly adaptable to propulsion. This new technology can revolutionize low-power electric propulsion for pico-, nano-, micro- and even larger satellites to perform various mission tasks including orbit transfer, station-keeping, position, attitude and acceleration control, and structure control.

Figure 2:
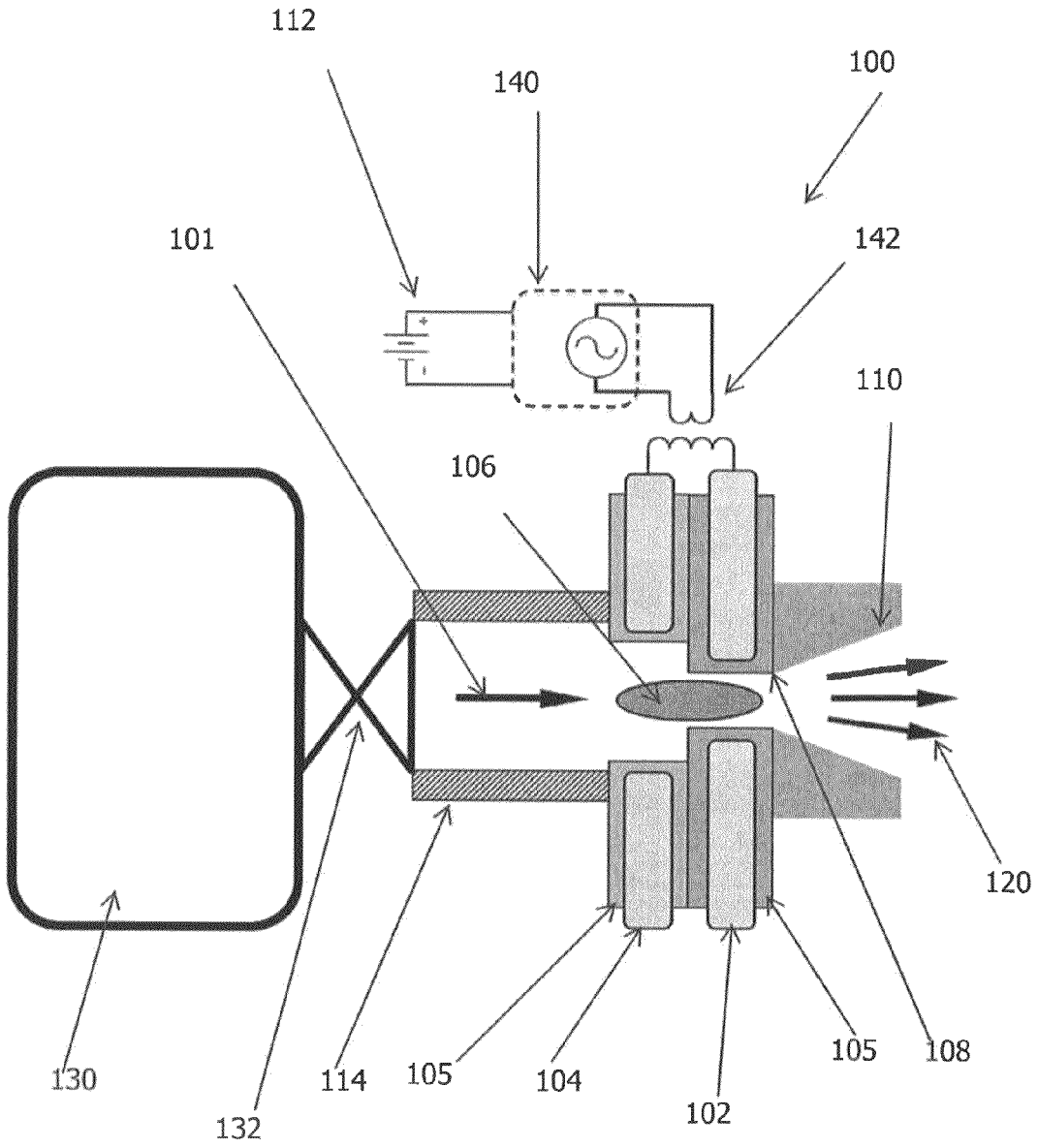
FIG. 2. is an MCD thruster schematic showing an insulated electrode pair and microcavity with integrated micronozzle.

The innovation forms the basis for a new class of electro-thermal thruster that is particularly applicable to satellites. Referring now to FIG. 2, the propulsion system 100 consists of 1) a gaseous propellant tank 130 and valve 132 used to control the release of a gaseous propellant 101 through feed tube walls 114, 2) an about 1000 V AC power source 112 with an about 5-500 kHz inverter 140 with step-up transformer 142, 3) two electrodes 102 and 104 that are insulated in a material 105 and that are capacitively coupled to an about 1 atm. plasma 106 in an about 100 μm diameter microcavity 108 and 4) a MEMs small-area ratio micronozzle 110 (similar to FIG. 3) to accelerate the gas and generate thrust 120

Figure 4:
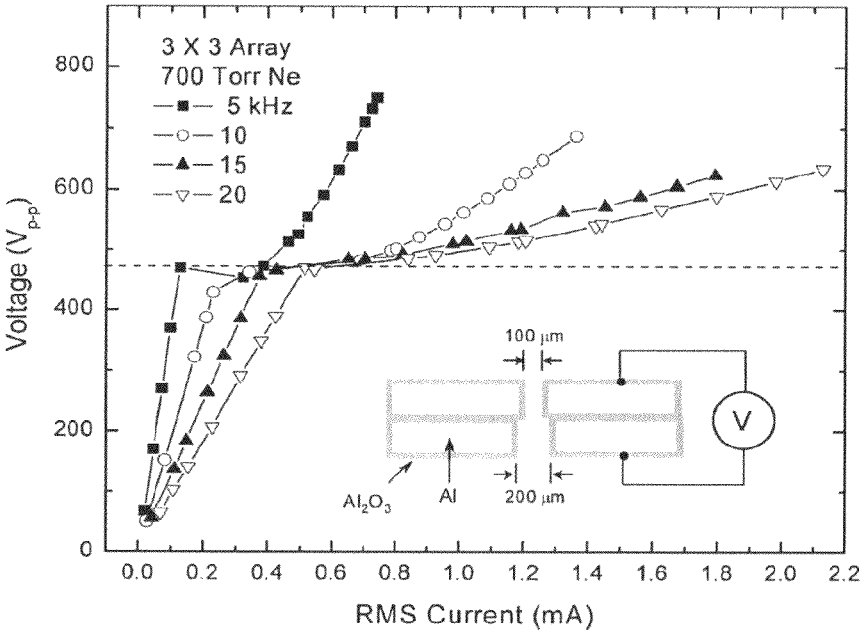
FIG. 4 Prior Art
FIG. 4. is a prior art chart illustrating the voltage-current (V-I) characteristics for a 3×3 pixel array of $Al_2O_3$/Al micro-discharge device.

One important aspect of one or more embodiments of the invention is potential scalability from very small to significantly large thrusters, as any desired number of cavities, also called pixels, can be run in parallel, with equally high efficiency. Unlike normal glow or arc discharges that have a negative resistance V-I characteristic and are thermally unstable in parallel without ballast, the cavities operate in the abnormal glow mode, with ionization fraction <<1% and a positive V-I characteristic (FIG. 4), thus allowing parallel operation and power scaling. A 1 $cm^2$ square pixel array with a pixel spacing of about 500 μm would have a 20×20 (400) pixels. FIGS. 1 and 4 display parallel operation of a 3×3 pixel matrix, at a power of about 0.13 W/pixel. As much as 2 W per pixel has been demonstrated, with a plasma temperature of about 1500 K, achieved with aluminum electrodes encapsulated in $Al_2O_3$.

Figure 5:
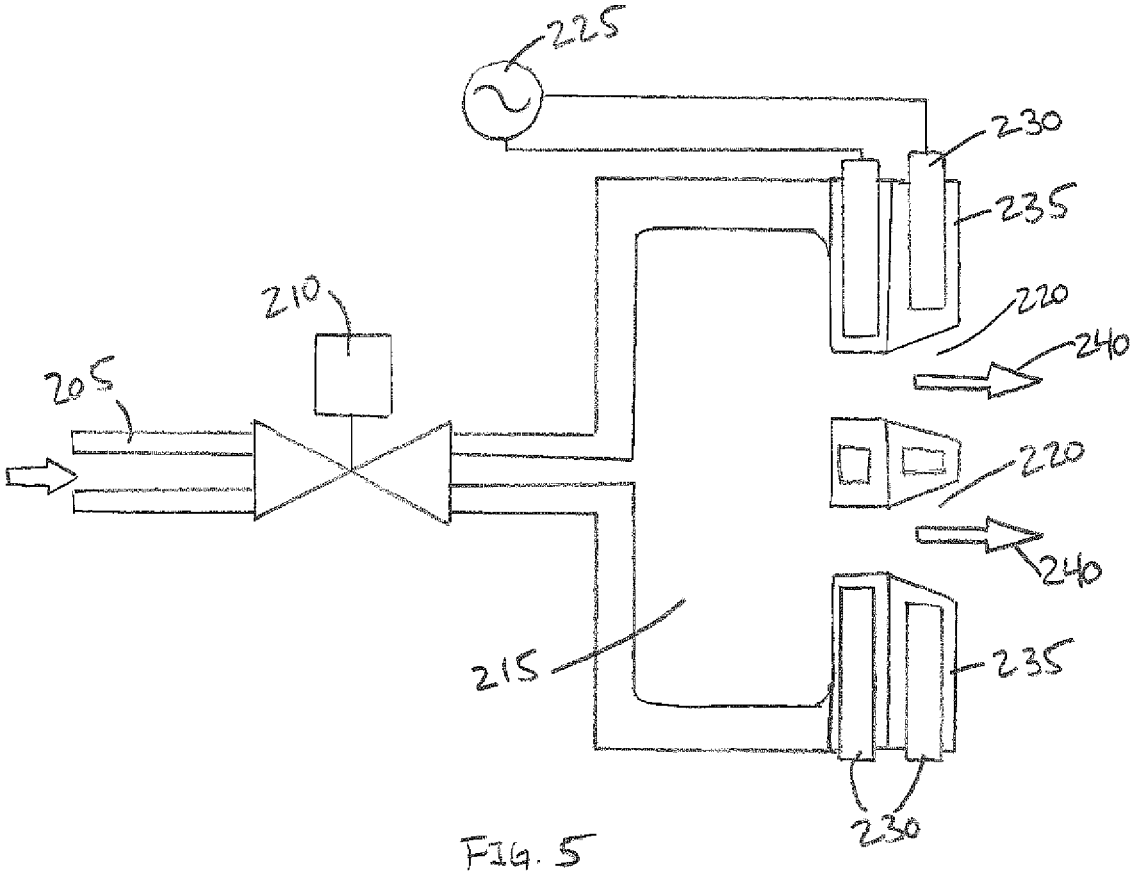
FIG. 5. Schematic of Microcavity Discharge (MCD) Thruster, showing multiple nozzles and capacitively-coupled AC electrodes.

The new type of thruster of this invention is to modify an MCD into an MCDT thruster, as shown schematically in FIG. 5. Our initial choices of propellant are neon and argon with a few percent $N_2$ or $H_2O$ seed gas, but other monatomic gases and ammonia show promise. These propellants are non-toxic and their implementation can build on the commercial microvalve and pressure control hardware developed for cold gas thrusters.

Figure 3:
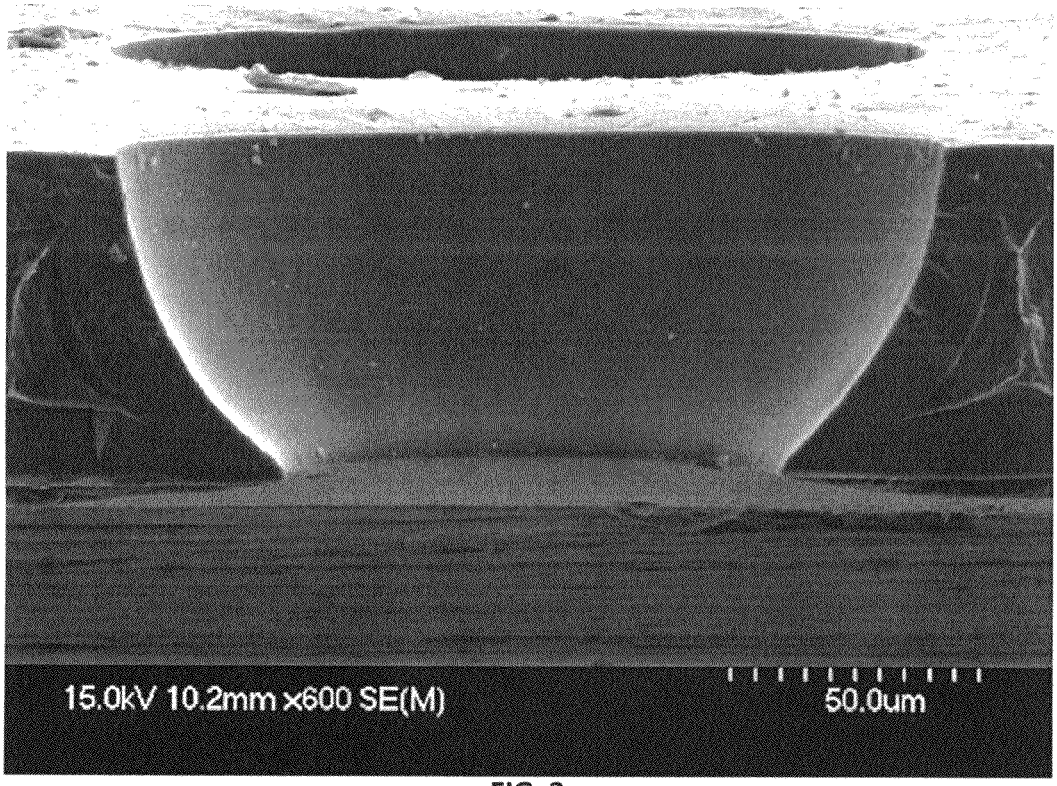
FIG. 3 Prior Art
FIG. 3. is a prior art Univ. of Illinois $Al_2O_3$ micro-machined bell nozzle capable of use with an MCD thruster.

The MCD thruster is a readily-modified version of an MCD by adding a properly designed plenum and nozzle/valve array (FIG. 5) and running it at high current and voltage, i.e. in the upper right of the V-I plot in FIG. 4, at a few watts per pixel at frequencies of around 5-100 kHz and higher. The MCD thruster will operated at a temperature of about 1500 K, previously-achieved by the MCD, and will attempt to go higher, including but not limited to 2000 K. The electrodes and nozzles can be fabricated in $Al/Al_2O_3$ material, with possible fabrication in a higher temperature electrode/insulator combination using materials such as titanium or SiC. The capability to machine conical and parabolic MEMs nozzle shapes into a cavity array has been demonstrated and this technology will be used for the first time on an MCD thruster (FIG. 3).

This new propulsion approach is based on recent advances in MEMS cavity discharges, developed at the University of Illinois. The MCD thruster is predicted to achieve >60% efficiency or greater at about 220 s with neon, or about 500 s with helium. Maximum input power will be about 1-3 W per cavity.

The gas propellant feed system is adapted from known technology, including filters to prevent particle contamination in about 100 μm orifices. The MCD is electrodeless, with $Al_2O_3$ insulation, and is therefore predicted to have a very long life, even with oxygen-containing propellant. Voltage levels are modest (<1 kV), and the system does not require a neutralizer for operation. The predicted thrust efficiency exceeds considerably that of the micro-resistojet at 60%. Performance, in terms of specific impulse, and thruster mass and volume, is much higher than that of the resistojet. Large arrays of these micro-cavities, as many as $400/cm^2$, could absorb about 1 $kW/cm^2$, resulting in a high power thruster with extremely low mass and high $thrust/cm^2$.

The MCD, the basis for the proposed thruster, has been under development at the University of Illinois by Prof. Gary Eden, Dr. Sung-Jin Park, and colleagues since 1997, and is the subject of numerous patents. To date, applications of the MCD are display light sources, and microchemical reactors. In these applications the plasma is sometimes static, but in most cases flows through the cavity driven by a differential pressure (herein after "Δp") of 0.2-0.3 atm. For the propulsion application, a flowing and accelerating plasma would be at a higher Δp (about 0.5-3.0 atm. across the microcravity and preferably around 0.5 to 1.5 atm.) and higher power input than has here-to-fore been demonstrated.

The predicted efficiency of 60% is much higher than that of other low power electrothermal, ion or Hall microthrusters, because:

1. Ionization fraction is <<1%, and frozen flow loss from ionized exhaust is negligible.

2. No auxiliary systems are needed, e.g. neutralizer, heater, igniter.

3. Operating pressure is a few atm., giving reasonable nozzle Reynolds numbers, and low viscous losses.

4. Power processing is accomplished with a DC-AC converter with low mass, and with PPU efficiency as high as 96%.

5. The system is electrodeless (meaning the electrodes are not exposed to the discharge gas because the electrodes are insulated), eliminating sheath loss and electrode ablation.

6. Power is capacitively coupled, so electrodes are cool, and heat loss is minimized. Power density is extremely high, typically $10^{12}$ $W/m^3$. Calculations of heat loss at the operating Reynolds number, using a Nusselt number model, predict a loss of less than 10% of the input power for argon, with the loss scaling as $(\text{molecular weight})^{-1/2}$ thus approaching 10-20% loss for helium. The primary reason the heat loss is low is that the cavity length is extremely low about 100-500 μm and most likely around 250 μm, resulting in a low wall area.

Additional features of the proposed MCD thruster system are:

1. The MCD thruster is throttleable by varying source pressure.

2. The MCD thruster has very low thrust noise, making it a candidate for certain AF and NASA missions requiring extremely precise, low-noise acceleration control.

3. High stagnation temperatures are possible, much higher than attainable with the resistojet (about 1500 K has been obtained with $Al/Al_2O_3$ electrodes), without the need for bulky, inefficient insulation. To achieve higher temperatures, a polyatomic seed gas can be added such as nitrogen or water vapor.

4. A very low system mass and volume is anticipated, allowing use on very small satellites with mass as little as about 1 kg.

Technology development on the MCD (Microcavity Discharge) began eleven years ago at the University of Illinois, with the objective of being used as a light source with practical applications for high resolution/thin-film plasma displays and medical treatment. In this case the MCD thruster is a variant of the MCD, originally made up of a 3×3 pixel array (FIG. 1), comprised of multiple pixels (i.e. emitters), each about 100 μm in diameter, fabricated by MEMS micro-machining. Experimentally determined voltage-current (V-I) characteristics for a 3×3 pixel array of $Al_2O_3/Al$ micro-discharge devices (FIG. 4), are for Ne at about 700 Torr and results are shown for sinusoidal AC excitation frequencies of 5, 10, 15, and 20 kHz. The dashed horizontal line indicates the approximate value of the ignition voltage, and the inset qualitatively illustrates the device structure (not drawn to scale). This technology was recently scaled to a large array size of 40,000 pixels giving us a great deal of confidence that MCD thruster technology can also be scaled for this propulsion application.

$Al/Al_2O_3$ Microcavities of Controllable Cross-Section

This new thruster leverages technology developed over the past several years at the University of Illinois in which microplasma devices having predetermined cross-sectional geometries can be fabricated with sidewalls of extraordinary quality (RMS surface roughness <1 μm). Precise control of the cavity profile and surface morphology is achieved with a sequence of wet electrochemical processes. Chemical micromachining enables the cavity cross-sectional profile, ranging from a linear taper to parabolic ("bowl-shaped") geometry, FIG. 3, to be specified while maintaining all dimensions to within ±2%. Aluminum electrodes produced by this process are buried in nanoporous $Al_2O_3$, encompass each microcavity, and the inner surface of every electrode is conformal to the profile of the $Al_2O_3$ microcavity wall. Arrays comprising as many as 51200 microcavity devices, each with a parabolic cross-section and an emitting aperture (d) of 160±2 μm, have been operated in Ne and Ne/Xe gas mixtures.

Figure 6:
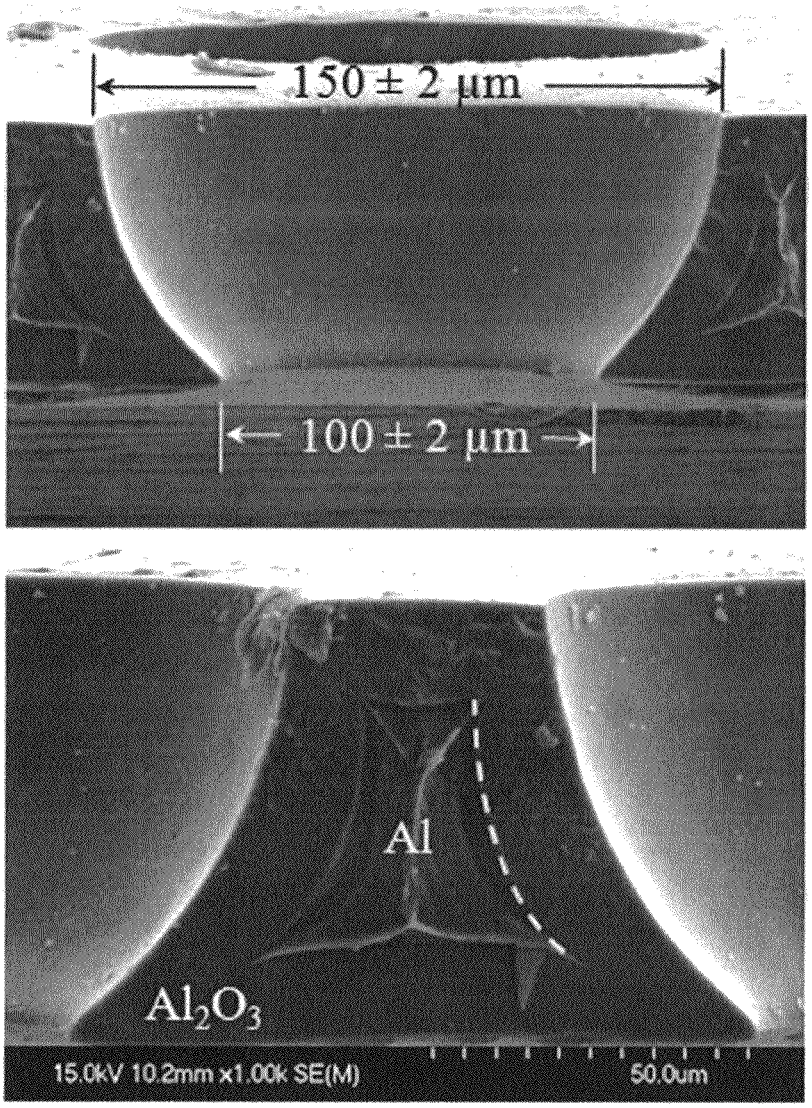
FIG. 6 is scanning electron micrographs (SEMS) of $Al_2O_3$ microcavities with parabolic cross-sections and buried, conformal Al electrodes.

Referring now to FIGS. 6A and 6B, there is shown a single microcavity with circular apertures about 150±2 μm and about 100±2 μm in diameter and a cross-sectional profile satisfying the relation: $y=At^{1/2}x^2+Bt$, where A and B are constants, t is the time devoted to etching the microcavity, y is the coordinate collinear with the microcavity axis, and x is the orthogonal coordinate in the plane of the page. Formed in $Al_2O_3$, this cavity is a replica of that etched electrochemically in Al. Virtually all of the original Al foil (about 127 μm thick in this case) has been converted into $Al_2O_3$ but the microcavity surface contour has been accurately preserved. A magnified, cross-sectional view of the region between two adjacent microcavities in a linear array of microplasma devices is presented by the SEM in FIG. 6B. At the center of this electron micrograph is a segment of the buried Al electrode that serves both microcavities. This structure is formed by the intersection of the ring electrodes encircling the neighboring cavities. As illustrated by the dashed white curve, the surfaces of the Al electrode facing each cavity exhibit a profile that matches the shape of the corresponding portion of the cavity wall. Electrode surfaces that are conformal to the microcavity wall are an inherent result of the anodization process, one that ensures the uniformity of the dielectric barrier thickness throughout the cavity. Note, too, the surface morphology of the cavities of FIG. 6. The RMS surface roughness is well under about 1 μm which is decidedly superior to that for cavities produced by mechanical methods, such as microdrilling or laser ablation. If the pitch for an array of cavities is increased beyond that of FIG. 6, the Al electrode cross-section tapers down to an Al strip interconnect thickness of 15 μm.

Figures 7A, 7B:
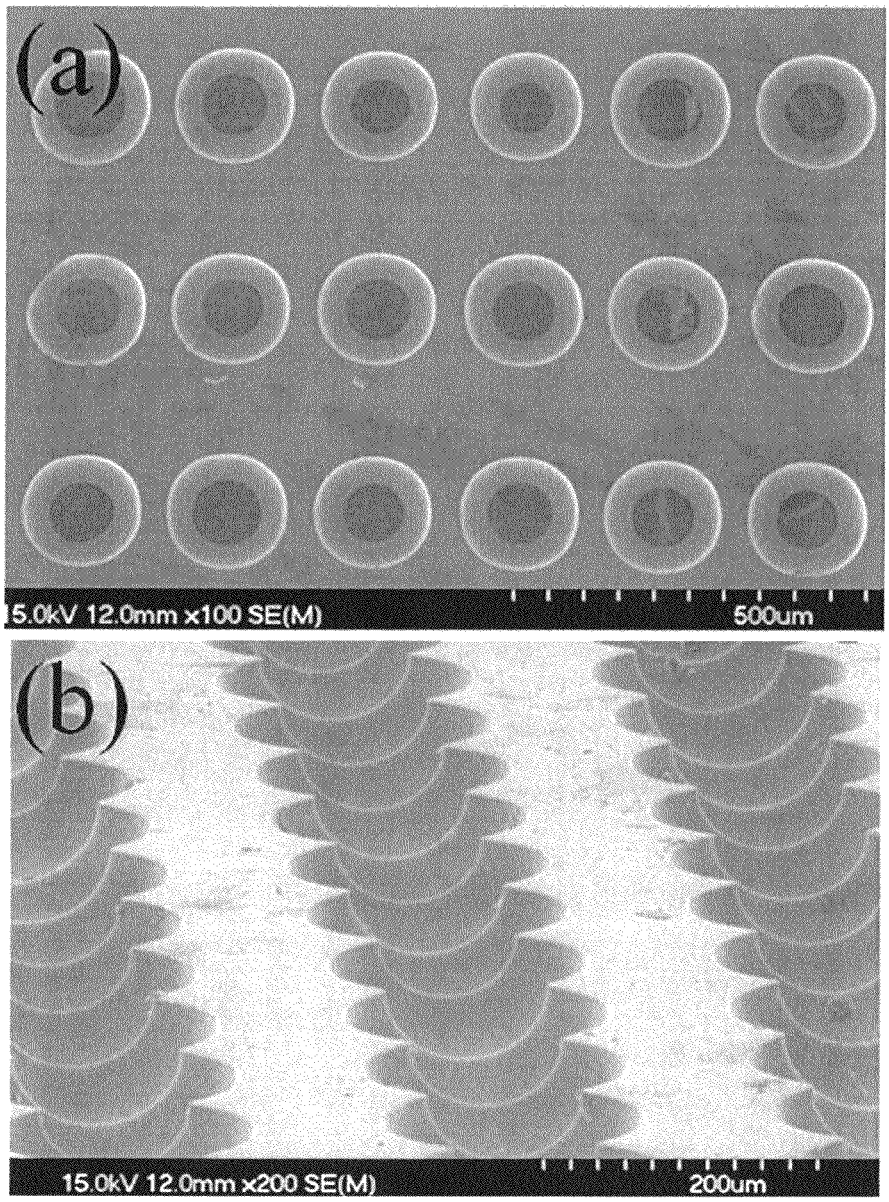
FIGS. 7*a* and 7*b* displays two images of arrays of parabolic cross-sectional microcavities.

FIG. 7 displays two images of arrays of parabolic cross-sectional microcavities. Panel (a) of the figure is an SEM in plan view of a portion of an array of $Al_2O_3$ cavities with upper and lower apertures about 160 μm and about 100 μm in diameter, respectively. A segment of a more closely packed array of microcavities is shown by the SEM of FIG. 7(*b*). Cavities in these linear arrays were designed to be overlapped by about 20% of the diameter of the emitting aperture.

Figure 8:
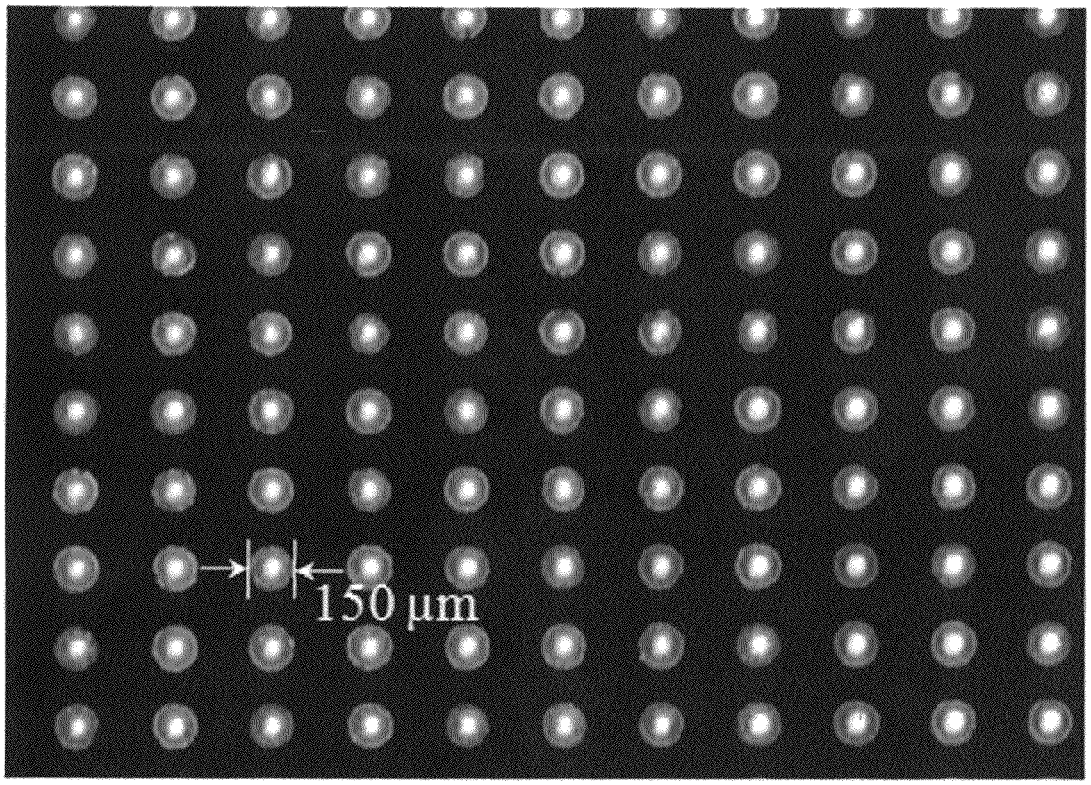
FIG. 8 is a Color Optical micrograph of an 11×10 segment of a 200×100 array of Al/$Al_2O_3$ parabolic microcavity plasma devices operating with 500 Torr of Ne, with a diameter of the emitting aperture for each cavity is about 150 μm and the excitation voltage waveform is a 20 kHz sinusoid.

FIG. 8 is a photograph, recorded with a telescope and CCD camera, of an 11×10 segment of a 200×100 array of microplasma devices, each having a parabolic cavity with an emitting aperture about 150 μm in diameter. The device pitch within a row is about 200 μm and the array is operating with about 500 Torr Ne and driven by about a 20 kHz sinusoidal AC waveform. Lineouts of CCD intensity maps show the variation of the peak emission from device-to-device to be within ±5% over the entire array, a result that is attributed to the quality of the microcavity wall surface and to stringent control of all microcavity dimensions.

Design and Fabrication of Microplasma/Nozzle Arrays

The ability for precision control of the geometry of a microcavity fabricated in $Al/Al_2O_3$ structures represents an enormous asset for this innovation, allowing us to systemically correlate thruster design with performance. Although we are confident that parabolic microcavities with exit apertures as small as about 10-20 μm in diameter (and, possibly, smaller) are achievable in the next 1-2 years, our near-term experiments will focus on about 50-100 μm diameter conical nozzles. Numerical analysis will determine the optimal profile for the nozzle surface that, in turn, dictates the processing parameters for the wet chemical fabrication sequence.

An important feature of the MCD thruster is the capability of operating at a Reynolds number sufficiently high so that the nozzle flow is not dominated by viscous effects. Typically this means Re>1000. Higher Re operation is possible because, although the diameter and length of the MCD thruster are small, the pressure is relatively high. This is necessary because the MCD, in order to maintain a low breakdown voltage of several hundred volts, typically operates at a pd (pressure times diameter) value of about 2-10 Torr-cm. At the upper end of the range, this implies that about a 100 mm (0.01 cm) diameter cavity needs a pressure of about 1000 Torr (about 1.3 atm). This value is sufficient to keep the Re high enough to operate the nozzle efficiently.

Another asset of microplasmas that was mentioned earlier is that these plasmas generally operate in the abnormal glow region in which the V-I characteristic has a positive slope. In contrast to conventional (macroscopic) plasmas, therefore, microplasma arrays do not require external ballast. However, it is important that the plasma resistivity is measured so that the driving electronics can be optimized. From the resistivity the degree of ionization a can be inferred. We expect a very low level of α, and hence a very small loss due to frozen flow.

MCD Thruster Efficiency

The efficiency of the MCD thruster can be supported by heat transfer calculations. The first approach is to calculate a heat transfer coefficient h [$W/m^2$-K] from the well-known Nusselt number relation Nu=hD/k, where $Nu=0.023(Pr)^{0.4}(Re)^{0.8}$, k is thermal conductivity and D is taken as $(A_{wall})^{1/2}$. For the MCD thruster the wall area is $A_{wall}=0.063\ mm^2$, giving D=0.25 mm. The Nusselt number calculation gives a heat transfer coefficient h for the MCD thruster of 520 $W/m^2$-K and the resulting $hA_{wall}$ is 3.3e-5.

Since the MCD thruster operates at a power level of (2-3 W) and a temperature of (1600-2000 K), the value of $hA_{wall}\Delta T$ is ~60 milliWatts, and the conclusion is that the MCDT has a small heat loss.

Wall Heat Loss (Second Model):

Here we present a model of the wall heat loss based on the Reynolds analogy, which relates heat transfer to skin friction through the statement that similar boundary layer solutions exist for the momentum and energy equations for laminar flow. The Reynolds Analogy relationship of heat transfer rate to shear stress, for fluid temperature T and velocity U, can be written:

$$\dot{q}_w = \frac{\tau_w C_p (T - T_w)}{U}$$

where $\dot{q}_w$ is the local wall heating, and $\tau_w$ is the local wall shear stress, related to the friction coefficient f and the fluid dynamic pressure $q=\rho U^2/2$ by:

$$\tau_w = f \cdot \frac{1}{2}\rho U^2$$

For low Re (laminar flow) the friction coefficient is given by f=16/Re. It is convenient to use the relation (mass flow)=ρUA [kg/s], where A=flow area, and write Re as:

$$\mathrm{Re} = \frac{4\dot{m}}{\pi D \mu}$$

We now combine the above equations and wind up with the simple relation:

local heating rate $$\dot{q}_w = \frac{8\mu C_p (T - T_w)}{D} [W/m^2]$$

where μ is the viscosity in Pa-s, and L is the length of the flow duct in meters. Assuming that $T_w$ is constant and that T(x) increases linearly from $T_w$ at x=0 to $T_{max}$ at x=L, the total wall heating loss is:

$$\dot{Q}_w = 4\pi\mu C_p (T_{max} - T_w) L$$

Note that the heat loss is independent of the diameter, and the fractional heat loss only depends on the flow duct length. The goal is to find the fractional heat loss, given by:

$$\theta = \frac{\dot{Q}_w}{P_{in}}$$

We write:

$$\text{Input power } P_{in} = \dot{Q}_w + \dot{m}C_p(T_{max} - T_w)$$

which after rearranging gives the simple expression for fractional heat loss q:

$$\frac{\theta}{1-\theta} = \frac{4\pi\mu L}{\dot{m}}$$

Note that for simplicity we have used an average value instead of a temperature-dependent value for viscosity. The model predicts that low L and high mass flow rate are desirable, the latter implying high pressure.

Finally, our past experience with other microthrusters has shown that the dominant flow loss is nozzle frozen flow loss due to dissociation and ionization. For the MCDT this is not a concern, since we use monatomic neon propellant, and the degree of ionization is very small (~0.01%).

It is likely that the major determiner of thrust efficiency is viscous losses in the nozzle due to the required Reynolds number regime. If the nozzle expansion drops the flow temperature to an exit temperature $T_e$, the nozzle thermal efficiency $\eta_N$ can be expressed as:

$$\eta_N = 1 - T_e/T_o = \frac{M_e^2}{M_e^2 + 3}$$

For the expected $M_e$=3 based on similar nozzles, $\eta_N$=0.75. When added to heat loss, plume divergence and distribution loss, we anticipate with confidence an MCD thrust efficiency of 60%.

Mass Flow Control

Resistojets show thrust characteristics that follow predictions for supersonic nozzles, when allowance is made for viscous effects by operating at a sufficiently high Reynolds number. Although the nozzle flow can become rarified, these effects can only be determined from numerical modeling. The other control question is that of the minimum impulse bit, which is important for precision location and attitude control. A straightforward calculation shows that the impulse bit of the MCD thruster is small enough for most requirements.

Consider a satellite of mass M, which must be kept positioned within a distance D [m]. In order to keep the control thruster duty cycle greater than a period of T [sec] between operations, the velocity must be kept below D/T [m/s], and the momentum, or impulse bit, below MD/T. Thus for a satellite of mass 1 kg, for D=1 mm and T=10 seconds, $I_{bit}<10^{-4}$ N-s=100 μN-s. This $I_{bit}$ can be achieved by an MCD thruster with a thrust of 1 mN and a thrust time of $t_T$=0.1 s. While valve operating time is far less than 0.1 s, the plenum volume feeding the MCDT must be sufficiently small. The condition is that the characteristic volume flow time $\tau=V_o/\dot{V}$ must be kept small compared to $t_T$, where $\dot{V}$ is the volume flow rate a*A*[$m^3$/s] at the throat. For neon and a throat diameter of 100 mm, this requires $V_o$=a*A*t<7 $mm^3$. This value of $V_o$ is achievable with a small MCD thruster array and close-coupled valve. While this example is extreme, it indicates that precision mass flow control with an MCD thruster can be achieved with very small impulse bits if required.

Referring back to FIG. 5, in one embodiment of the present invention there is provided an electrothermal thruster system 200. The system 200 includes a gaseous propellant feed line 205, with upstream propellant tank (not shown) holding a pressurized gaseous propellant. A controlled valve 210 is further coupled to the feed line 205 for controlling the release of gaseous propellant from the tank into a plenum 215. At least one microcavity 220 is coupled to the plenum. The at least one microcavity has a preferred diameter of about 50-300 microns and more preferred diameter of about 100 microns. The system 200 further includes an alternating current power source 225 in communication with a pair of electrodes 230 insulated in a material 235, for which power is supplied to heat the gaseous propellant into a plasma with a temperature of about 500-4000 K, wherein increasing the temperature of the plasma through the microcavity 220 increases the velocity of the plasma as it discharges out of the microcavity producing thrust 240.

In other embodiments, the at least one microcavity can be an array of microcavities operating electrically and fluid dynamically in parallel, wherein the size of the array is at least 100,000 microcavities. In addition, the system may further include a converging-diverging micronozzle downstream of each microcavity that expands the heated propellant, accelerating it to create a supersonic exhaust jet.

In yet other embodiments, the insulated material is aluminum oxide ($Al_2O_3$) and/or the electrodes can be made of one or more of the following: titanium, titanium oxide, or silicon carbide.

Yet further may be a system having the power source operated at a discharge radio frequency of about 5 to 500 kHz which is created from a DC bus voltage using a DC-AC inverter and step-up transformer, providing a voltage and current at about 1000 V and about 1 ma, for a typical power into each microcavity of about 1 watt.

The gaseous propellant may be a monatomic gas such as but not limited to xenon, krypton, argon, neon, or helium and the gaseous propellant may be seeded with a few percent of polyatomic gases such as nitrogen or water vapor to increase power.

In yet further embodiments the thruster system may include a differential pressure through the system of about 0.2 to about 3 atms and in other embodiments, about 0.5 to about 1.5 atms.

SUMMARY OF ADVANTAGES

The microcavity discharge (MCD) thruster is expected to be a high specific thrust, high thrust density, high specific power system, with high propellant utilization and a simple power processor. Efficiency is predicted as greater than 60%, and power scalability is straightforward over a wide range. Lifetime is expected to be long, due to the lack of electrode sheaths and the capability of operating without an auxiliary neutralizer.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A method of operating an electrothermal thruster in the vacuum of space, the electrothermal thruster having:

a gaseous propellant tank holding a gaseous propellant at a first pressure, a controlled valve coupled to the gaseous propellant tank for controlling a release of the gaseous propellant from the gaseous propellant tank into a plenum at a second pressure, and at least one microcavity coupled to the plenum, the at least one microcavity having a diameter of about 50-300 microns, the method comprising:

heating the gaseous propellant from the plenum into a plasma with a temperature of about 500-4000 K, wherein the heating of the gaseous propellant is achieved by providing a sequence of discharges from an alternating current in communication with a pair of electrodes insulated in a material;

supplying a power to the pair of insulated electrodes at a discharge frequency of about 5 to 500 kHz and supplying a voltage at about 1000 V with a discharge current amplitude at about 1 mA; and wherein the temperature of the plasma through the at least one microcavity increases, resulting in an increase in a velocity of the plasma as it discharges out of the at least one microcavity producing thrust, and further resulting in less than 1% ionization of the gaseous propellant from the plenum.

2. The method of claim 1 wherein the at least one microcavity is an array of microcavities operating electrically and fluid dynamically in parallel.

3. The method of claim 1 further comprising expanding the plasma with a temperature of about 500-4000 K through a converging-diverging micronozzle downstream of each microcavity, where the exit of the micronozzle is located in a vacuum, resulting in accelerating the plasma to create a supersonic exhaust jet.

4. The method of claim 1, wherein the material insulating the pair of electrodes is aluminum oxide ($Al_2O_3$).

5. The method of claim 1, wherein the pair of electrodes can be made of titanium.

6. The method of claim 1, wherein the gaseous propellant is a gas selected from one of the following: xenon, krypton, argon, neon, ammonia, or helium.

7. The method of claim 6, further comprising seeding the gaseous propellant with a gas, selected from one of the following: nitrogen or water vapor, resulting in an increased absorbed electrical power.

8. The method of claim 1, wherein the diameter of the at least one microcavity is preferably about 100 microns.

9. The method of claim 1, wherein the first pressure of the gaseous propellant is pressurized such that a differential pressure of the gaseous propellant drives the gaseous propellant through the at least one microcavity into a vacuum.

10. The method of claim 9, wherein the differential pressure is about 0.2 to about 3 atms.

11. A method of operating an electrothermal thruster in the vacuum of space, the thruster having a propellant tank holding a gaseous propellant at a first pressure, a controlled valve coupled to the propellant tank for controlling a release of the gaseous propellant from the propellant tank into a plenum having a second pressure lower than the first pressure in the tank, and at least one microcavity coupled to the plenum, the at least one microcavity having a diameter of about 50-300 microns, the method comprising:

releasing the pressurized gaseous propellant from the gaseous propellant tank into the plenum;

supplying power to a pair of insulated electrodes at a discharge frequency of about 5 to 500 kHz and supplying a voltage at about 1000 V with a discharge current amplitude at about 1 mA to provide heat; and heating the gaseous propellant in the plenum into a plasma to a temperature of about 500-4000 K, wherein the temperature of the plasma through the at least one microcavity increases, resulting in an increase in a velocity of the plasma as it discharges out of the at least one microcavity producing thrust, and further resulting in less than 1% ionization of the gaseous propellant from the plenum.

12. The method of claim 11 wherein the at least one microcavity is an array of microcavities operating electrically and fluid dynamically in parallel.

13. The method of claim 11 further comprising expanding the plasma with a temperature of about 500-4000 K through a converging-diverging micronozzle downstream of each microcavity, where the exit of the micronozzle is located in a vacuum, resulting in accelerating the plasma to create a supersonic exhaust jet.

14. The method of claim 11, wherein the gaseous propellant is a gas selected from one of the following: xenon, krypton, argon, neon, ammonia or helium.

15. The method of claim 11, further comprising seeding the gaseous propellant with a gas, selected from one of the following: nitrogen or water vapor, resulting in an increased absorbed electrical power.

16. The method of claim 11, wherein the first pressure of the gaseous propellant is pressurized such that a differential pressure of the gaseous propellant drives the gaseous propellant through the at least one microcavity into a vacuum.

17. The method of claim 16, wherein the differential pressure is between about 0.2 to about 3.0 atms.

* * * * *